United States Patent [19]

Reising

[11] Patent Number: 5,069,432

[45] Date of Patent: Dec. 3, 1991

[54] DEVICE FOR HOLDING A GLASS WORKPIECE WHILE SHAPING

[76] Inventor: William S. Reising, 3 Hardy Rd., Whitehall, Del.

[21] Appl. No.: 505,172

[22] Filed: Apr. 5, 1990

[51] Int. Cl.[5] ..... B25B 1/00

[52] U.S. Cl. ..... 269/3; 269/254 CS

[58] Field of Search ..... 269/6, 254 CS, 908, 269/3, 268, 156; 81/53.11; 294/19.1

[56] References Cited

U.S. PATENT DOCUMENTS 145,945 12/1873 Hewitt ..... 269/254 CS 172,734 1/1876 Havck ..... 269/254 CS 3,159,395 12/1964 Mussett et al. ..... 269/6

*Primary Examiner*—Robert C. Watson

*Attorney, Agent, or Firm*—Mortenson & Uebler

[57] ABSTRACT

A device for holding glass workpieces while they are shaped by a glassblower is provided. The device includes a hollow shaft handle to one end of which is affixed a clamping means. The clamping means is adjustable longitudinally along the shaft handle, and it may be rotated with respect to the long axis of the shaft handle and about the shaft handle. The clamping means is spring-loaded to provide to secure holding of the workpiece when in use.

6 Claims, 3 Drawing Sheets

DEVICE FOR HOLDING A GLASS WORKPIECE WHILE SHAPING

BACKGROUND OF THE INVENTION

The invention relates to apparatus for holding glass workpieces while they are being shaped by a glassblower.

Devices for holding glass workpieces are known. Exemplary of such devices are those disclosed in U.S. Pat. No. 17,960 (1857) and U.S. Pat. No. 241,976 (1881) which show spring-loaded clamping devices for holding glass workpieces.

Other spring-loaded clamping devices are presently currently available from the Herbert Arnold GmbH & Co. KG, 6290 Weilburg/Lahn, Weilstrasse 6, Postfach 1220, West Germany.

Another clamping device is disclosed in the journal *Fusion,* June, 1956, pp. 14–15.

No known devices provides apparatus for holding a glass workpiece comprising a hollow shaft handle to one end of which is affixed clamping means which are adjustable longitudinally along the shaft handle and rotatable with respect to the long axis of the shaft handle and is also rotatable about the shaft handle.

SUMMARY OF THE INVENTION

A device for holding a glass workpiece while finishing is provided. The device comprises an elongate hollow shaft handle at one end of which is affixed clamping means for holding the workpiece. The clamping means comprises an externally threaded sleeve member slideably mounted over the shaft, an internally threaded annular swivel block member threadingly engaged over the sleeve, two arms rotatably affixed at their one end to the swivel block member and having affixed at their other ends a generally U-shaped retaining ring. The shaft at its end having the clamping means is threadingly engaged with a backing flange, the backing flange having a ridged head means attached thereto, the ridges of which accommodate standard glass workpieces. A spring mechanism is located between the backing flange and the swivel block member. The device provides clamping means which are adjustable longitudinally along the shaft handle and which are rotatable with respect to the long axis of the shaft handle and also are rotatable about the shaft handle. The shaft handle, sleeve, arms, spring and retaining ring preferably are stainless steel. The swivel block and backing flange preferably are titanium. The ridged head preferably is graphite.

DETAILED DESCRIPTION OF THE INVENTION AND PREFERRED EMBODIMENTS WITH REFERENCE TO THE DRAWINGS

A device for holding glass workpieces while they are shaped by a glassblower is provided. The device includes a hollow shaft handle to one end of which is affixed a clamping means. The clamping means is adjustable longitudinally along the shaft handle, and it may be rotated with respect to the long axis of the shaft handle and about the shaft handle. The clamping means is spring-loaded to provide for secure holding of the workpiece when in use.

Figure 1:
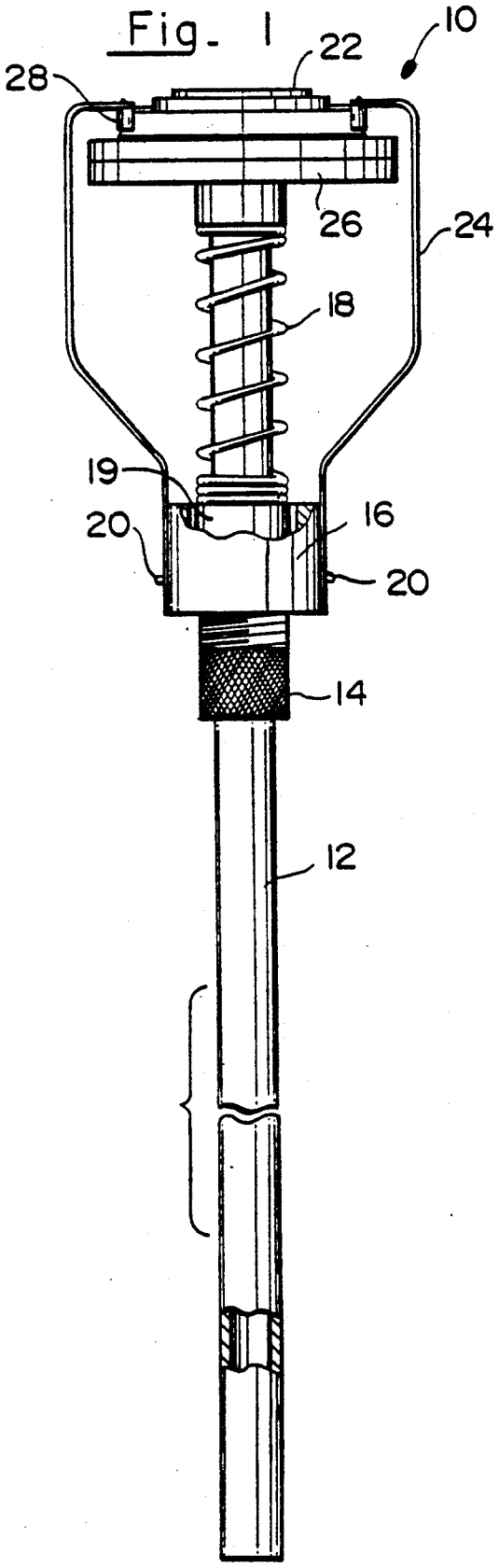
FIG. 1 is a front elevational view of the device of the invention.

A detailed description of the invention and preferred embodiments is best provided with reference to the accompanying drawings wherein FIG. 1 is a front elevational view of the device 10 of the invention. The device 10 for holding a glass workpiece while shaping includes an elongate, hollow tubular shaft handle 12 having affixed at its upper end, as shown, clamping means for holding the glass workpiece. The clamping means comprise externally threaded and knurled sleeve 14 slideably mounted over shaft 12. Internally threaded annular swivel block member 16 is threadingly engaged over sleeve 14 Two arms or straps 24 are rotatably affixed at one end to swivel block member 16 by means of pins or rivets 20. These arms 24 have affixed to their other ends a generally U-shaped retaining ring 28. Shaft 12, at the end having the clamping means, is threadingly engaged, as shown, with backing flange 26. This backing flange 26 has a ridged head means 22 attached thereto, the ridges of which are sized to accommodate standard glass workpieces. Spring mechanism 18 is located around shaft 12 between the backing flange 26 and the swivel block member 16. The spring mechanism 18 abuts slip ring member 19, as shown.

According to the invention, device 10 provides clamping means which are adjustable longitudinally along the shaft handle 12 and which are rotatable with respect to the long axis of the shaft 12 and are also rotatable about the centerline of handle 12.

Materials of construction of the various components of the device 10 of the invention will be known to persons skilled in this art. Preferred materials include stainless steel for the shaft handle 12, sleeve 14, arms 24, spring 18 and retaining ring 28, titanium for the swivel block 16 and backing flange 26, graphite for the ridged head 22, and stainless steel for pins or rivets 20.

Figure 2:
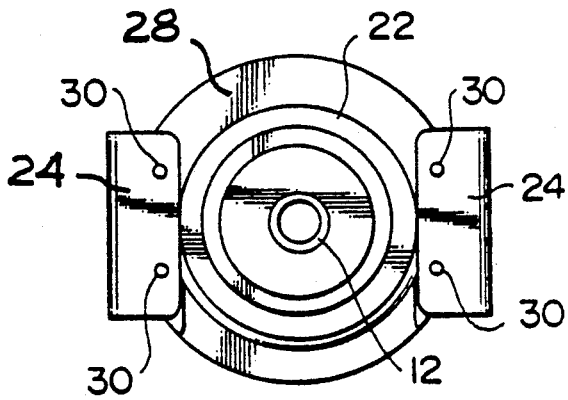
FIG. 2 is a top plan view of the device.

FIG. 2 shows a top plan view of the device 10 of the invention without a workpiece in place. Shaft 12 is seen in the center of head 22. Arms 24 are affixed to U-shaped retaining ring 28 by screws 30.

Figure 3:
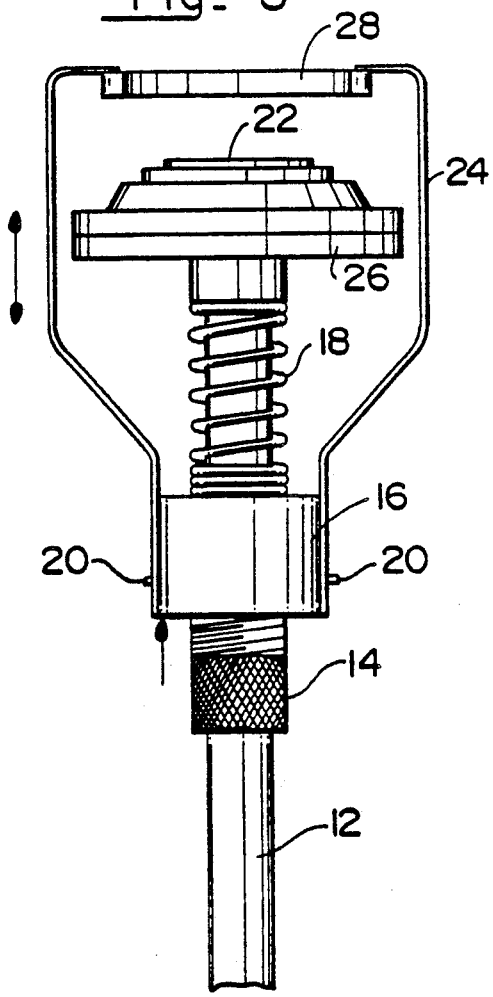
FIG. 3 is a rear elevation of the device wherein the spring is being compressed by a force indicated by the arrow, such as by the user's thumb, such that the clamping mechanism can be opened.

FIG. 3 is a rear elevation showing the clamping mechanism being opened. Therein, an upward force is applied to swivel block 16 such as by the user's thumb. This is indicated by the single-headed arrow. When force is applied as shown, spring 18 is compressed and straps 24 with ring 28 attached move upwardly. The straps 24 and ring 28 can be rotated with respect to the long axis of shaft 12, thereby enabling the user to place a workpiece on the graphite head 22. This is described more fully below in the description of FIG. 6.

Figure 4:
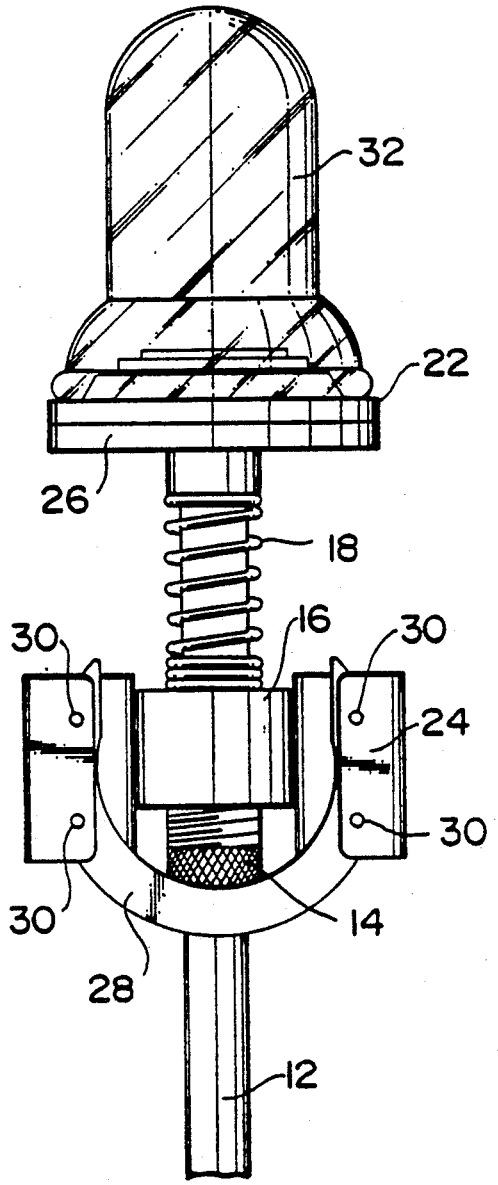
FIG. 4 is a rear elevation of the device in the open, set-up position, with a standard glass workpiece placed on the ridged head means.
Figure 5:
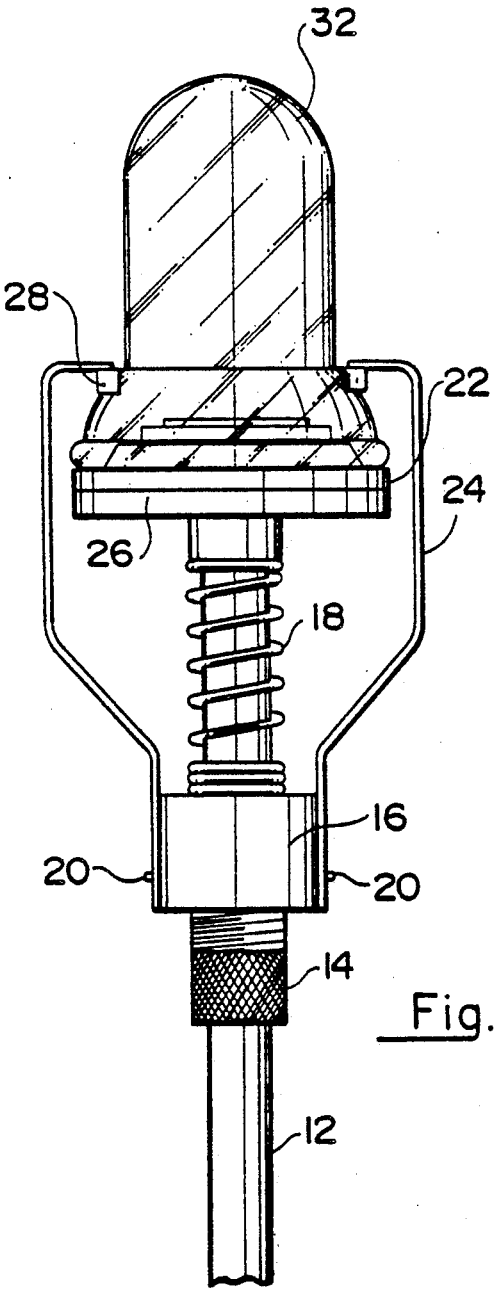
FIG. 5 is a front elevation of the device in the clamped position ready to begin finishing the glass workpiece.

FIG. 4 shows a rear elevation of the device of the invention in the clamp-open position wherein a standard glass workpiece 32 has been placed on graphite head 22. Swivel block 16 is then forced upwardly, compressing spring mechanism 18 and the straps 24 and attached ring 28 are swiveled into place; the upward force is removed, and the clamping mechanism securely holds the glass workpiece in place, as shown in the rear elevation of FIG. 5.

Figure 6:
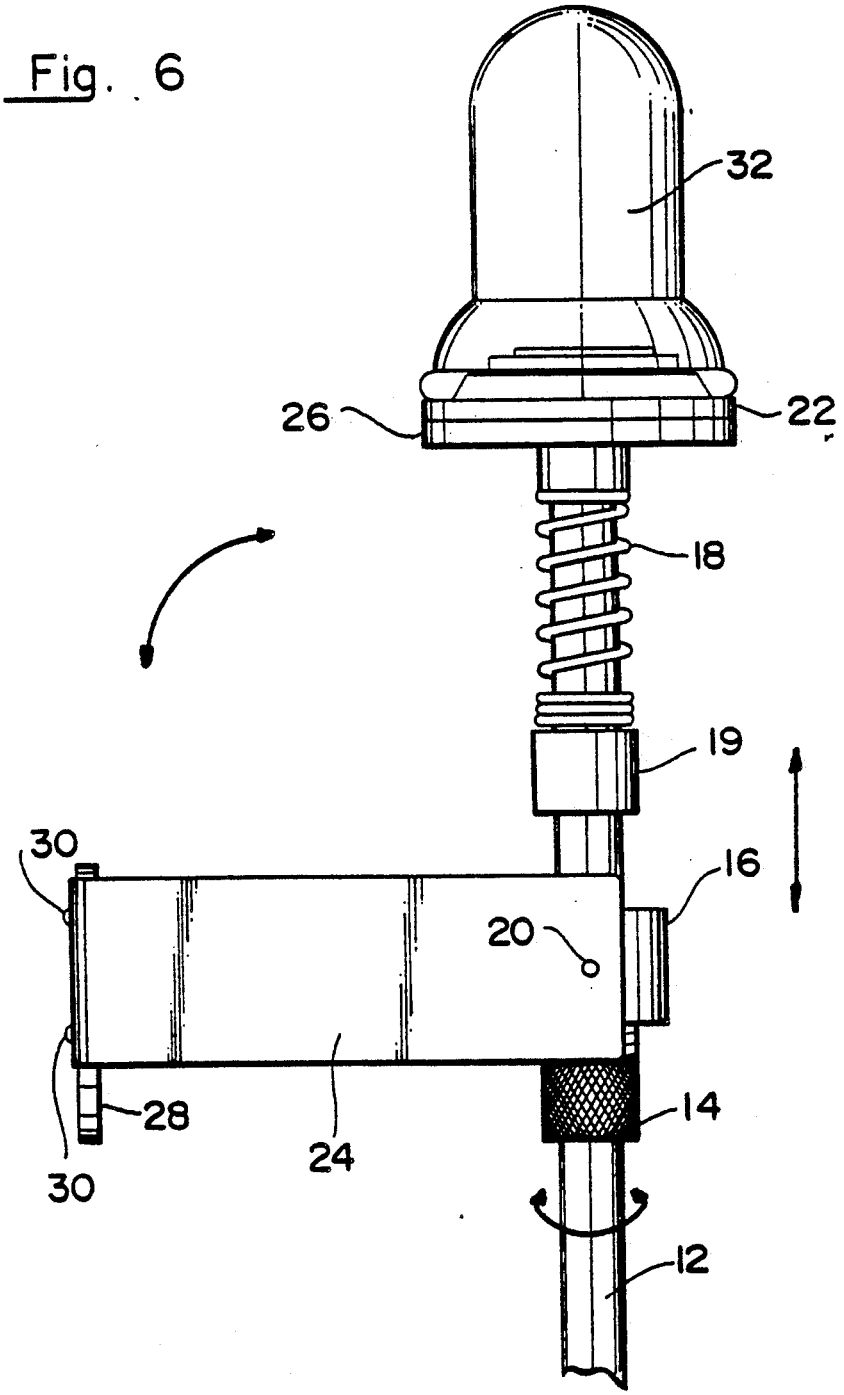
FIG. 6 is a side elevation showing the device in the open position wherein the double-headed arrows indicate the three (3) degrees of freedom of movement of the clamping mechanism.

FIG. 6 shows an exploded side elevation of the components of the invention wherein the clamping means are in the open position. The double-headed arrows indicate the three (3) degrees of freedom of movement of the clamping means with respect to shaft 12. Arms 24 with clamp ring 28 can rotate with respect to the long axis of shaft 12. The clamping means can be moved longitudinally with respect to shaft 12. And the entire clamping means can be rotated about the axis of shaft 12.

Once a workpiece has been installed in device 10, the glassblower is provided with a convenient and efficient tool for holding the workpiece in a flame for further working and finishing.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A device for holding a glass workpiece while finishing comprising an elongate hollow shaft handle at one end of which is affixed clamping means for holding said workpiece, said clamping means comprising an externally threaded sleeve member slideably mounted over said shaft, an internally threaded annular swivel block member threadingly engaged over said sleeve, two arms rotatably affixed at their one end to said swivel block member and having affixed at their other ends a generally U-shaped retaining ring, said shaft at its end having the clamping means being threadingly engaged with a backing flange, said backing flange having a ridged head means attached thereto, the ridges of which accommodate standard glass workpieces, and a spring mechanism located between said backing flange and said swivel block member, whereby said clamping means are adjustable longitudinally along the shaft handle, are rotatable about an axis orthogonal to the long axis of the shaft handle and also are rotatable about said shaft handle.

2. The device of claim 1 wherein said shaft handle, sleeve, arms, spring and retaining ring are stainless steel.

3. The device of claim 1 wherein said swivel block and backing flange are titanium.

4. The device of claim 1 wherein said ridged head is graphite.

5. The device of claim 1 wherein said arms are affixed to said swivel block by means of stainless steel pins

6. The device of claim 1 wherein said arms are affixed to said swivel block by means of stainless steel rivets.

* * * * *